US006192203B1

(12) United States Patent
Nishio et al.

(10) Patent No.: US 6,192,203 B1
(45) Date of Patent: Feb. 20, 2001

(54) IMAGE FORMING APPARATUS WITH TRANSFER VOLTAGE CONTROLLED ACCORDING TO TEMPERATURE AND HUMIDITY

(75) Inventors: Yukio Nishio, Fukuoka; Yoshiyuki Okamura; Yoshinobu Kohno, both of Kurume, all of (JP)

(73) Assignee: Matsushita Electric Industrial, Co., Ltd., Osaka (JP)

( * ) Notice: Under 35 U.S.C. 154(b), the term of this patent shall be extended for 0 days.

(21) Appl. No.: 09/437,242

(22) Filed: Nov. 10, 1999

(30) Foreign Application Priority Data

Nov. 12, 1998 (JP) ..... 10-321790

(51) Int. Cl.[7] ..... G03G 15/16
(52) U.S. Cl. ..... 399/44; 399/66
(58) Field of Search ..... 399/44, 66

(56) References Cited

U.S. PATENT DOCUMENTS 4,912,515 * 3/1990 Amemiya et al. ..... 399/44

FOREIGN PATENT DOCUMENTS 1-11279 * 1/1989 (JP) .
3-197988 * 8/1991 (JP) .
6-161294 * 6/1994 (JP) .

* cited by examiner

*Primary Examiner*—Joan Pendegrass
(74) *Attorney, Agent, or Firm*—Stevens, Davis, Miller & Mosher, LLP

(57) ABSTRACT

An image forming apparatus has a voltage information storing unit in which data of transfer voltages in correspondence to predetermined discontinuous temperatures and humidity are stored. In the case that measured temperature and humidity of an atmosphere out of the apparatus do not coincide with discontinuous temperature and humidity stored in the voltage information storing unit, a proper transfer voltage is applied to a medium transfer roller by interpolating data of the stored transfer voltage so as to calculate the transfer voltage and applying the transfer voltage to the medium transfer roller.

3 Claims, 4 Drawing Sheets

IMAGE FORMING APPARATUS WITH TRANSFER VOLTAGE CONTROLLED ACCORDING TO TEMPERATURE AND HUMIDITY

BACKGROUND OF THE INVENTION

1. Field of the Invention

The present invention relates to an image forming apparatus, and particularly relates to a technique effective for improving an image quality in an electrophotographic system type image forming apparatus.

2. Description of the Prior Art

In recent years, in an electrophotographic system type image forming apparatus, there is a structure which adjusts an optimum value of a transfer voltage applied to a transfer roller on the basis of a temperature and a humidity detected by a temperature and humidity detecting sensor in order to obtain a stable transfer quality even under an environment where a temperature, a humidity and the like momentarily change.

There is a difference between a transfer voltage optimum for properly transferring multi-layered toners such as a color image and the like and a transfer voltage optimum for properly transferring a single-layered toner such as a monochrome image and the like, and the respective optimum voltages are changed in accordance with a change of an environment (a temperature and a humidity). In particular, in an image in which a multi-layered toner image and a single-layered toner image simultaneously exist, since the optimum transfer voltage is different in each of the layers, it is necessary to change the transfer voltage in a further fine manner in accordance with the respective environments. Further, the optimum transfer voltage also changes in accordance with a value of volume resistance and a value of surface resistance of a recording medium (a paper, a plastic film and the like).

Then, in a conventional technique, it is structured such that the optimum transfer voltage is determined by performing a printing test under various kinds of environments such as every recording mediums, every printing modes, for example, one-sided printing, both-sided printing and the like, every printing speeds and the like, an environment near a receiving place of the recording medium within a color electrophotographic image forming apparatus is detected by the temperature and humidity detecting sensor, and the transfer voltage is controlled in accordance with a kind and a temperature and humidity of the recording medium.

Accordingly, in the conventional color electrophotographic image forming apparatus, it is necessary to perform a printing test under the various kinds of environments such as every recording mediums, every printing modes, every printing speeds and the like so as to determine the optimum transfer voltage. Then, the more the conditions such as the recording mediums, the printing modes, the printing speeds, the temperature and humidity and the like become increased, the more a recording amount of a memory becomes increased.

In this kind of conventional color electrophotographic image forming apparatus, in order to reduce a memory capacity as much as possible, or in order to reduce a number of the printing tests as much as possible, it is preferable to prepare desultory transfer voltage data at every predetermined temperatures or every predetermined humidity, that is, the transfer voltage data with respect to discontinuous temperature and humidity in place of preparing the transfer voltage data corresponding to all the temperatures and humidity.

However, in the case that only these discontinuous data are prepared as mentioned above, there is a problem that a large difference is generated between a proper transfer voltage and an actual transfer voltage near a boundary of the defined temperature and humidity, thereby deteriorating an image quality. In particular, in the case that the temperature and the humidity gradually change in response to a lapse of time, there is a case that an image quality is significantly deteriorated when the temperature or the humidity becomes over a certain temperature or a certain humidity.

SUMMARY OF THE INVENTION

An object of the present invention is to provide an image forming apparatus which can apply a proper transfer voltage at a measured temperature and humidity to a transfer roller on the basis of transfer voltage data with respect to discontinuous temperatures and humidity.

According to the present invention, there is provided an image forming apparatus having a voltage information storing unit for storing data of transfer voltages in correspondence to predetermined discontinuous temperatures and humidity. If measured ambient temperature and humidity do not coincide with the stored discontinuous temperature and humidity, a proper transfer voltage is applied to a medium transfer roller by interpolating data of the stored transfer voltage so as to calculate the transfer voltage to be applied to the medium transfer roller.

More particularly, in order to achieve the above-stated objectives, in accordance with the present invention, there is provided an image forming apparatus comprising:

- a toner image carrier for carrying a toner image formed in correspondence to image data;
- transfer means to which a voltage having a polarity different from that of the toner is applied and which transfers the toner image formed on the toner image carrier to a recording medium;
- temperature and humidity detecting means for measuring a temperature and a humidity of an atmosphere within the apparatus or out of the apparatus;
- voltage information storing means in which data of transfer voltages corresponding to predetermined discontinuous temperatures and humidity are stored; and
- control means for calculating a transfer voltage by using data of the transfer voltage in correspondence to the stored temperatures and humidity and measured temperature and humidity in the case that the measured temperature and humidity do not coincide with the discontinuous temperature and humidity stored in the voltage information storing means.

Accordingly, it is possible to apply the proper transfer voltage at the measured temperature and humidity to the transfer means on the basis of the transfer voltage data prepared with respect to the discontinuous temperature and humidity.

DESCRIPTION OF THE PREFERRED EMBODIMENT

An embodiment in accordance with the present invention will be described below with reference to FIGS. 1 to 4.

Figure 1:
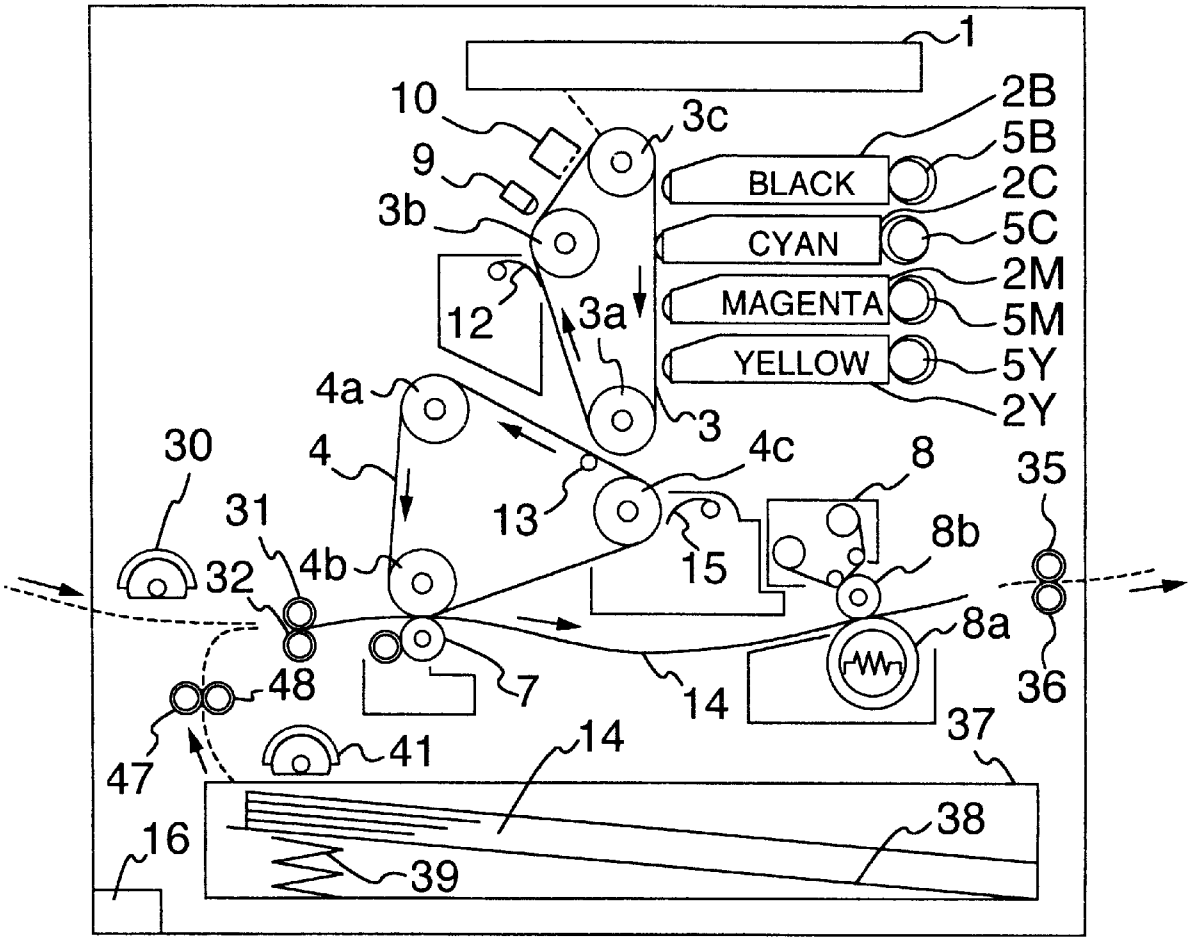
FIG. 1 is a schematic view which shows an inner structure of a color electrophotographic image forming apparatus in accordance with an embodiment of the present invention.
Figure 2:
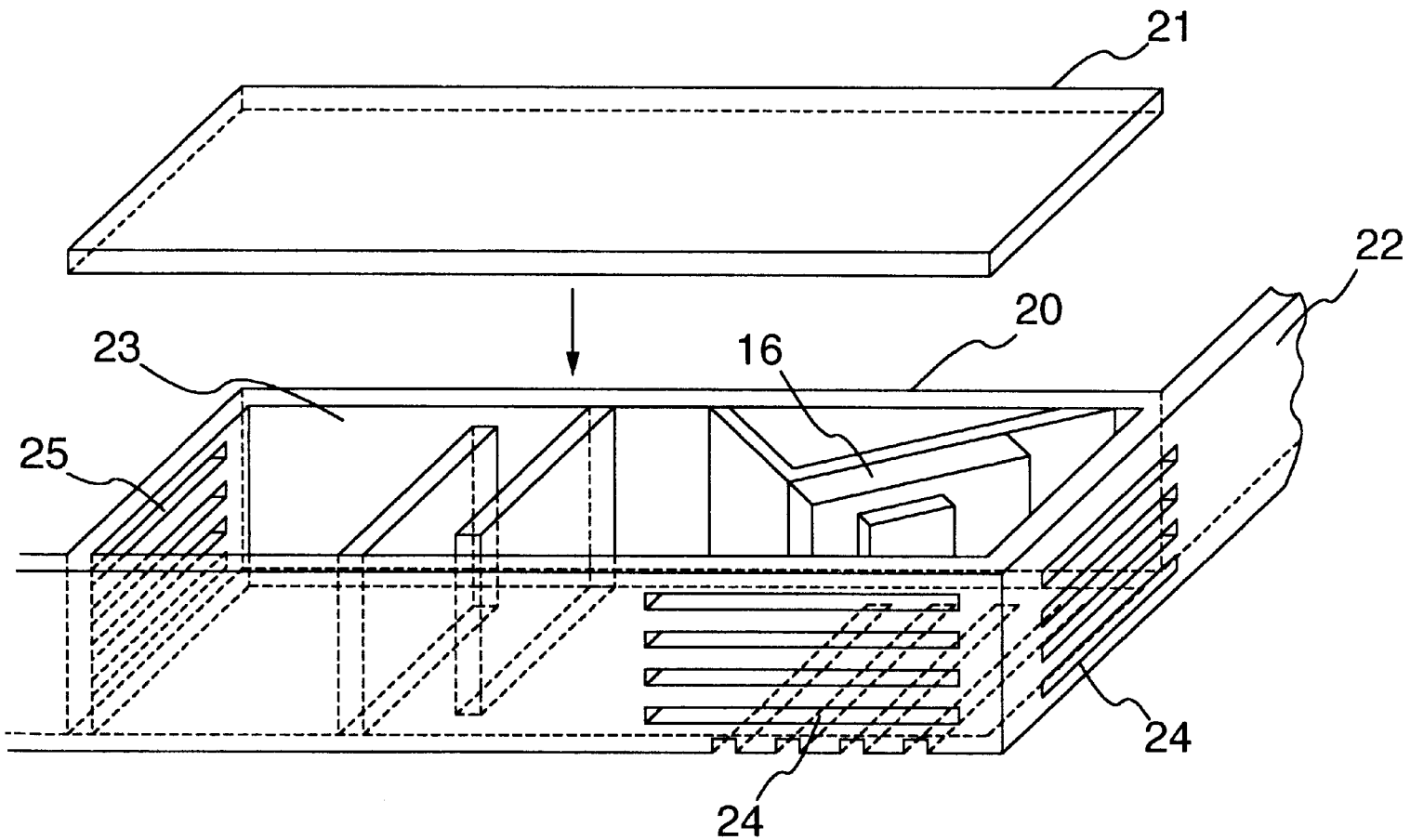
FIG. 2 is a perspective view which shows a temperature and humidity detecting sensor mounted to the color electrophotographic image forming apparatus shown in FIG. 1.
Figure 3:
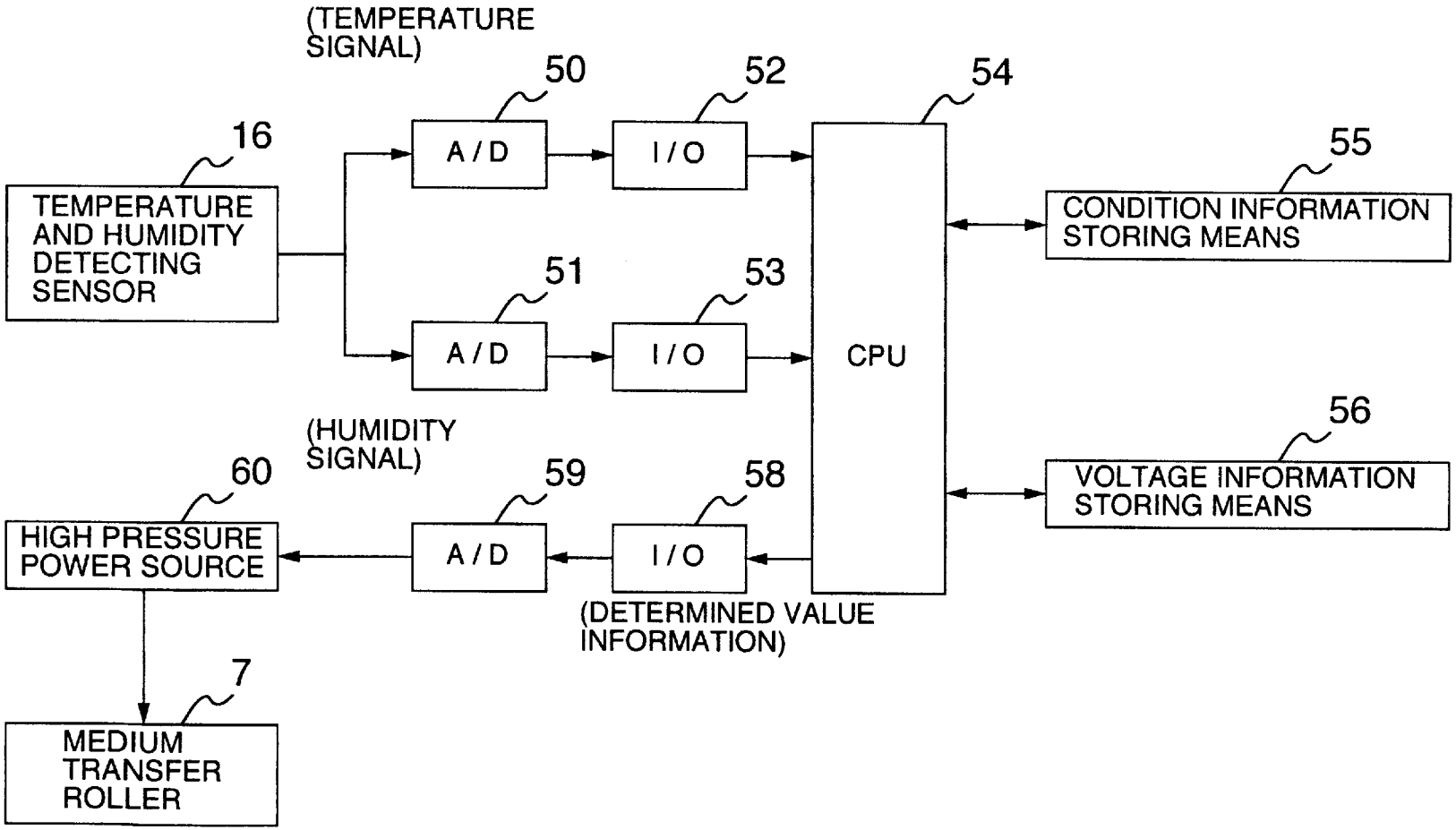
FIG. 3 is a block diagram which shows a structure of controlling a transfer voltage to a medium transfer roller.
Figure 4:
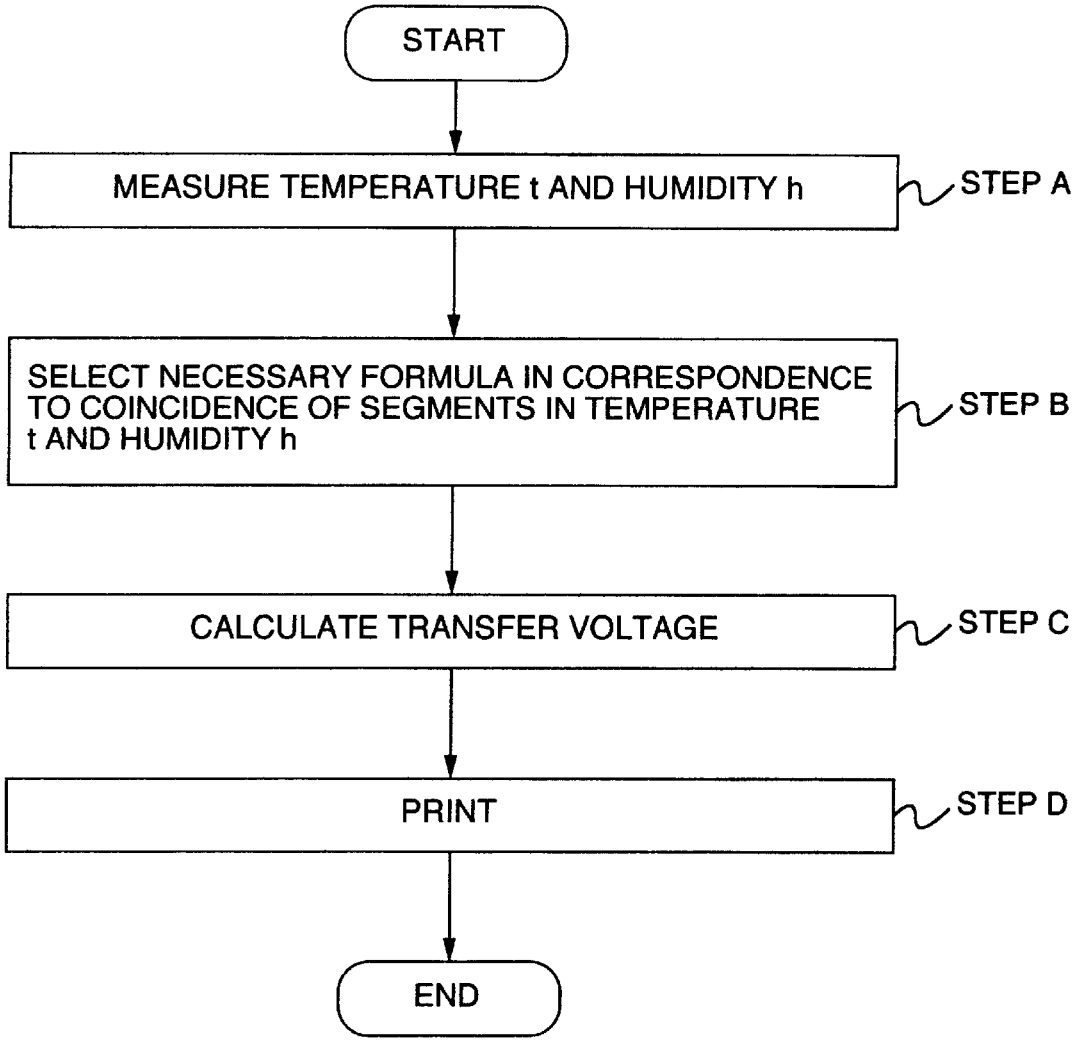
FIG. 4 is a flow chart which shows a determination process of a value of the voltage for transferring to the medium transfer roller performed by a CPU in the case of recording on a sheet.

FIG. 1 is a schematic view which shows an inner structure of a color electrophotographic image forming apparatus in accordance with an embodiment of the present invention, FIG. 2 is a perspective view which shows a temperature and humidity detecting sensor mounted to the color electrophotographic image forming apparatus shown in FIG. 1, FIG. 3 is a block diagram which shows a structure of controlling a transfer voltage to a medium transfer roller and FIG. 4 is a flow chart which shows a determination process of a value of the voltage for transferring to the medium transfer roller performed by a CPU in the case of recording on a sheet.

In FIG. 1, a photosensitive body belt (photosensitive body) 3 on which a photosensitive image receiving layer such as an organic photo conductor (OPC) and the like is coated in a thin film manner is adjusted and supported by three photosensitive body belt supporting and conveying rollers 3*a*, 3*b* and 3*c* so as to form a horizontal surface, and is circulated along the photosensitive body belt supporting and conveying rollers 3*a*, 3*b* and 3*c* by a driving motor. Developing units 2B, 2C, 2M and 2Y receiving toners respectively corresponding to black (B), cyan (C), magenta (M) and yellow (Y) are provided on an upper portion of the photosensitive body belt 3 along an outer peripheral surface thereof. A photosensitive body cleaning apparatus 12 for removing a toner left in the photosensitive body belt 3, a discharging unit 9 having an LED lamp arranged in parallel and discharging the photosensitive body belt 3, and a charging unit 10 for charging the photosensitive body belt 3 due to a corona discharge are placed in the side of the photosensitive body belt 3, and further, a laser unit 1 is provided.

Then, the charging unit 10 is corona discharged by applying a high voltage to the charging unit 10, and the photosensitive body belt 3 is uniformly charged. Further, a laser beam irradiated by the laser unit 1 is controlled in accordance with a signal from a host computer so as to form a plurality of electrostatic latent images respectively corresponding to specific components among a plurality of predetermined color components on the photosensitive body belt 3.

The developing units 2B, 2C, 2M and 2Y respectively corresponding to the colors are respectively arranged in predetermined receiving portions provided in the main body of the apparatus at a uniform interval and in a freely detachable manner, and an inner portion of each of the developing units 2B, 2C, 2M and 2Y is structured in the same manner except a kind of the received toner.

Contact cams 5B, 5C, 5M and 5Y for bringing the developing units 2B, 2C, 2M and 2Y into contact with the photosensitive body belt 3 at a time of developing the electrostatic latent image having a predetermined color are provided in correspondence to the respective developing units 2B, 2C, 2M and 2Y, and the developing units 2B, 2C, 2M and 2Y are held a standby position apart from the photosensitive body belt 3 at a time of not being pressed in a direction of the photosensitive body belt 3 by the contact cams 5B, 5C, 5M and 5Y.

An intermediate transferring body unit has an intermediate transferring body belt (an intermediate transferring body) 4 made of a conductive resin and the like, and three intermediate transferring body belt supporting and conveying rollers 4*a*, 4*b* and 4*c* on which the intermediate transferring body belt 4 is adjusted and supported. In order to transfer the toner image disposed on the photosensitive body belt 3 on the intermediate transferring body belt 4, an intermediate transferring roller 13 is arranged in such a manner as to be opposed to the photosensitive body belt 3 with respect to the intermediate transferring body belt 4.

In this case, a peripheral length of a surface of the intermediate transferring body belt 4 is set such as to be equal to a peripheral length of a surface of the photosensitive body belt 3. In order to scrape out a remaining toner on the intermediate transferring body belt 4, an intermediate transferring body belt cleaning apparatus 15 is placed near the intermediate transferring body belt supporting and conveying roller 4*c*. The intermediate transferring body belt cleaning apparatus 15 is apart from the intermediate transferring body belt 4 during a formation of a composite image on the intermediate transferring body belt 4, and is brought into contact with the intermediate transferring body belt 4 only at a time of being used for cleaning.

A paper cassette (recording medium holding means) 37 for receiving a paper (a recording medium) 14 is provided in a lower portion of the apparatus. Then, the paper 14 is held within the paper cassette 37 in a state of being layered on a mounting table 38 pressed by a spring 39, picked up by a paper supply roller 41 one by one, and fed out to a paper conveying path by conveying rollers 47 and 48. In this case, in addition to the paper conveying path fed out from the paper cassette 37 in this manner, there is a paper conveying path for performing a pick-up operation from a manual inserting tray by a paper supply roller 30.

In order to coincide a position of the paper 14 with a position of the composite image formed on the intermediate transferring body belt 4, a resist roller 31 for temporarily stopping the paper 14 and remaining the paper 14 at a standby position is provided in such a manner as to be brought into contact with a driven roller 32. Further, a medium transfer roller (a transfer roller) 7 for transferring the composite image formed on the intermediate transferring body belt 4 on the paper 14 by an application of a voltage having a polarity different from that of the toner is provided on the paper conveying path, and is rotated in such a manner as to be in contact with the intermediate transferring body belt 4 only at a time of transferring the composite image on the paper 14. The medium transfer roller 7 is, for example, made of a carbon type conductive foamed polyurethane named RUBY CELL (trade mark) manufactured by TOYO POLYMER CO., LTD. In this case, in addition to the paper 14, for example, an OHP film may be applied to the recording medium.

In order to fix the composite image transferred to the paper 14, a fixing device (fixing means) 8 comprising a heat roller 8*a* having a heat source therewithin and a pressing roller 8*b* is arranged. Then, the composite image transferred by a pressure and a heat together with a nipping and rotation between the heat roller 8*a* and the pressing roller 8*b* when the sheet 14 passes within the fixing device 8 is fixed on the paper 14, so that a color image is formed, and the sheet 14 is held between discharging rollers 35 and 36 and discharged out of the apparatus.

In this case, a temperature and humidity detecting sensor (temperature and humidity detecting means) 16 for detecting a temperature and a humidity (a relative humidity RH) at an outer portion of the apparatus is mounted to the present apparatus.

As shown in FIG. 2, the temperature and humidity detecting sensor 16 is arranged in an intermediate chamber 23 formed within a casing 22 in such a manner as to be separated from the other portions by a partition wall 20 and a cover 21. The intermediate chamber 23 is constituted by a slit 24 formed in the casing 22 in such a manner as to form the same environment as the external atmosphere. Further, a slit 25 is also formed in the partition wall, and an external air introduced into the intermediate chamber 23 through the slit 24 is introduced via the slit 25 into the apparatus which is under negative pressure due to a fan. Accordingly, the temperature and humidity detecting sensor 16 can accurately detect an environmental state of the external air without being influenced by a heat generated within the apparatus.

As shown in FIG. 3, a temperature signal and a humidity signal output from the temperature and humidity detecting sensor 16 are converted into digital signals by A/D converters 50 and 51 so as to be output to I/O ports 52 and 53, and are input to a CPU (control means) 54. Condition information storing means (memory means) 55 is connected to the CPU 54, and the structure is made such that the condition information data such as a kind of the recording medium (a kind such as a paper, a plastic film and the like, a specification such as a thickness and the like), an operating condition information of the apparatus (a process speed, whether a monochrome printing or a color printing, whether a both-sided printing or a one-sided printing) and the like are fed from the condition information storing means 55 or to the condition information storing means 55. A voltage information storing means 56 is connected to the CPU 54, and the structure is made such that the transfer voltage data (Table 1) to the medium transfer roller 7 stored in the voltage information storing means 56 is fed to the CPU 54.

Then, in the CPU 54, the optimum voltage applied to the medium transfer roller 7 is output on the basis of these data. The output signal is converted into an analogue signal from the I/O port 58 by the D/A converter 59 and input to a high voltage power source 60, whereby the voltage indexed by the CPU 54 is supplied to the medium transfer roller 7.

In this case, the temperature data immediately before transferring the image to the paper 14 is employed. Further, the humidity data correspond to data obtained by calculating an average value at a fixed period (for example, every ten minutes) so as to be stored in the condition information storing means 55, and the data which has been already stored in the condition information storing means 55 at a time of transferring the image to the paper 14 are employed. Accordingly, even when a value detected by the temperature and humidity detecting sensor 16 is changed during the transfer, the transfer voltage is not changed.

Here, the transfer voltage data stored in the voltage information storing means 56 will be shown in Table 1.

TABLE OF TEMPERATURE AND HUMIDITY WITH RESPECT TO TRANSFER VOLTAGE

| | HUMIDITY | | |
|---|---|---|---|
| TEMPERATURE | 38% RH | 44% RH | 51% RH |
| 13° C. | 60 | 47 | 43 |
| 18° C. | 57 | 45 | 42 |
| 25° C. | 54 | 42 | 40 |

Table 1 shows a relation between the temperature and humidity and the transfer voltage, in which nine transfer voltages are given in a matrix in a combination of the case that the temperature is 13° C., 18° C. and 25° C. and the case that the humidity is 38% RH, 44% RH and 51% RH. That is, the transfer voltage data are prepared with respect to the discontinuous temperature and humidity.

In this case, in Table 1, the transfer voltage value in the range that the temperature is equal to or less than 12° C. and equal to or more than 26° C. and the humidity is equal to or less than 37% RH and equal to or more than 52% RH is omitted, however, it is possible to apply the transfer voltage in correspondence to the temperatures and the humidity, respectively. Further, the table between the temperature and humidity and the transfer voltage mentioned above is different in accordance with the kind of the recording medium and is prepared at every kinds.

In this case, numerals in the voltage values within Table 1 indicate normal dimensions, for example, "45" means that an actually applied voltage is obtained by multiplying the numeral by 19.71 and thereafter adding 346.4 thereto. Accordingly, the voltage of 1233.4 V is applied by the numeral "45". In this specification, this numeral is called as a notch unit. In this case, all of these voltage values are determined by the experiments.

In the electrophotography apparatus structured in a manner mentioned above, an operation thereof will be described below.

In FIG. 1, after uniformly discharging the charged photosensitive body belt 3 by the discharging unit 9, a high voltage is applied to the charging unit 10 connected to the high voltage power source so as to perform a corona discharge, thereby uniformly charging the surface of the photosensitive body belt 3 to a level of about −500 v to −650 v.

Next, the photosensitive body belt 3 is circulated by a drive apparatus such as a motor and the like, so that a laser beam corresponding to an image of a predetermined color, for example, a black (B) among a plurality of color components is irradiated on the surface of the uniformly charged photosensitive body belt 3. Accordingly, an electric charge disappears from a portion on which the laser beam is irradiated on the photosensitive body belt 3 and a electrostatic latent image is formed thereon. On the contrary, a developing unit 2B receiving the toner of the black used for development is brought into contact with the photosensitive body belt 3 in accordance that the contact cam 5B half rotates by a color selecting signal from the host computer and the like. Then, a thin-layered toner to which a predetermined voltage is applied is attached to the electrostatic latent image, so that the toner image can be formed.

The developing unit 2B in which the development is finished in this manner moves to a standby (an apart) position from the contact position with the photosensitive body belt 3 in accordance that the contact cam 5B further half rotates. In this case, during a development of the developing unit 2B, the other developing units 2C, 2M and 2Y are apart from the photosensitive body belt 3.

Next, for example, when a color of a cyan (C) is selected, the developing unit 2C is brought into contact with the photosensitive body belt 3, and starts a development of a cyan by the same operation as that mentioned above. In the case of using four colors, the operation of this development is successively repeated for four times, and the four-layered toner image corresponding to four colors B, C, M and Y is transferred on the intermediate transfer body belt 4 in an overlapping manner, so that the composite image is formed thereon. In this case, single layer toner image, two layers toner image and three layers toner image are respectively formed in the case of a color, two colors and three colors.

A little toner left on the photosensitive body drum 3 without being transferred is cleaned by the photosensitive body cleaning apparatus 12 and waits for the next process.

The composite image formed in this manner is wholly transferred to the paper 14 conveyed from the paper cassette 37 along the paper conveying path when a high voltage having a polarity opposite to that of the toner is applied to the medium transferring roller 7.

Next, a description will be given of a process of determining the transfer voltage value to the medium transfer roller 7 by the CPU 54 in the case of recording on the paper 14, with reference to the flow chart shown in FIG. 4.

A temperature t and a humidity h are measured by the temperature and humidity detecting sensor 16 (a step A) and input to the CPU 54. In this case, for example, it is supposed that the temperature is 20° C. and the humidity is 45% RH.

Next, it is ascertained whether or not the measured temperature t and the humidity h are defined in Table 1, and a necessary formula is selected (a step B).

Here, in the case that both of the measured temperature t and humidity h are defined in Table 1, no formula is selected, and the transfer voltage given by the normal dimension in Table 1 is applied as it is.

Further, in the case that none of the measured temperature t and humidity h are defined in Table 1, respective upper and lower temperatures and humidity of the measured temperature t and humidity h are selected, and the following formula is selected as a linear interpolation on the basis of four transfer voltage values indicated by the temperatures and humidity.

$$\begin{aligned} R(t, h) = \{&R(Tn, Hn)\times(h-Hn-1)\times(t-Tn-1)+ \\ &R(Tn, Hn-1)\times(Hn-h)\times(t-Tn-1)+ \\ &R(Tn-1, Hn)\times(h-Hn-1)\times(Tn-t)+ \\ &R(Tn-1, Hn-1)\times(Hn-h)\times(Tn-t)\}\div \\ &\{(Hn-Hn-1)\times(Tn-Tn-1)\} \end{aligned} \quad \text{FORMULA 1}$$

As mentioned above, since the measured values in this case correspond to the temperature of 20° C. and the humidity of 45% RH, four transfer voltage values 45 notch, 42 notch, 42 notch and 40 notch can be obtained from Table 1 on the basis of the temperatures 18° C. and 25° C. and the humidity 44% RH and 51% RH. Accordingly, in this case, the following formula obtained by substituting concrete numerals for the above-mentioned formula.

$$\begin{aligned} R(20^\circ\text{ C.}, 45\%) = \{&R(25^\circ\text{ C.}, 51\%)\times(45-44)\times \\ &(20-18)+R(25^\circ\text{ C.}, 44\%)\times \\ &(51-45)\times(20-18)+ \\ &R(18^\circ\text{ C.}, 51\%)\times \\ &(45-44)\times(25-20)+ \\ &R(18^\circ\text{ C.}, 44\%)\times \\ &(51-45)\times(25-20)\}\div \\ &\{(51-44)\times(25-18)\} \\ =&(40\times1\times2+42\times6\times2+ \\ &42\times1\times5+45\times6\times5)\div(7\times7) \\ \approx&44\ \text{[notch]} \end{aligned} \quad \text{FORMULA 2}$$

When the formula is selected in the manner mentioned above, an interpolated value is obtained by substituting predetermined numerals so as to calculate the transfer voltage (a step C).

Accordingly, a predetermined interpolated value can be obtained, and the transfer voltage can be determined by this value. In this case, in accordance with the present embodiment, 44 notch can be obtained as the interpolated value, and the transfer voltage 1213.6 V can be determined. In this case, in the calculation, the place down to the decimal point is rounded to the nearest whole number.

When the transfer voltage is calculated, the voltage is output from the high voltage power source 60 and applied to the medium transfer roller 7, and a printing of the composite image is performed under the optimum transfer voltage (a step D).

In this case, in the case that only the temperature t is defined in Table 1 at the step B, the following formula is selected as the formula for the linear interpolation.

$$\begin{aligned} R(t, h) = \{&R(t, Hn)\times(h-Hn-1)+ \\ &R(t, Hn-1)\times(Hn-h)\div \\ &(Hn-Hn-1) \end{aligned} \quad \text{FORMULA 3}$$

Further, in the case that only the humidity h is defined in Table 1 at the step B, the following formula is selected as the formula for the linear interpolation.

$$\begin{aligned} R(t, h) = \{&R(Tn, h)\times(t-Tn-1)+ \\ &R(Tn-1, h)\times(Tn-t)\div \\ &(Tn-Tn-1) \end{aligned} \quad \text{FORMULA 4}$$

As mentioned above, in accordance with the present embodiment, since the structure is made such as to interpolate the transfer voltage data corresponding to the discontinuous temperature and humidity by the CPU 54 so as to calculate the transfer voltage in the case that the measured temperature and humidity do not coincide with the discontinuous temperature and humidity stored in the voltage information storing means 56, it is possible to apply the proper transfer voltage at the measured temperature and humidity to the medium transfer roller 7 on the basis of the transfer voltage data prepared with respect to the discontinuous temperature and the humidity.

As mentioned above, in accordance with the present invention, since the structure is made such as to interpolate the transfer voltage data corresponding to the discontinuous temperature and humidity by the control means so as to calculate the transfer voltage in the case that the measured temperature and humidity do not coincide with the discontinuous temperature and humidity stored in the voltage information storing means, there can be obtained an effect that it is possible to apply the proper transfer voltage at the measured temperature and humidity to the medium transfer roller on the basis of the transfer voltage data prepared with respect to the discontinuous temperature and the humidity.

Accordingly, since it is not necessary to prepare the transfer voltage data with respect to all of the temperatures and humidity, there can be obtained an effect that it is possible to stably form the image having a good quality on the recording medium while reducing the necessary memory capacity.

Further, since it is not necessary to prepare the transfer voltage data with respect to all of the temperatures and humidity as mentioned above, there can be obtained an effect that it is possible to stably form the image having a good quality on the recording medium while reducing a number of the printing tests for preparing the transfer voltage data so as to reduce a developing labor.

In this case, the temperature and humidity detecting sensor 16 is structured such as to detect the temperature and the humidity of the atmosphere in the outer portion of the apparatus, however, it is needless to say that an inner portion of the apparatus may be measured although an accuracy is reduced.

What is claimed is:

1. An image forming apparatus comprising:

a toner image carrier for carrying a toner image formed in correspondence to image data;

transfer means to which a voltage having a polarity different from that of the toner is applied and which transfers the toner image formed on said toner image carrier to a recording medium;

temperature and humidity detecting means for measuring a temperature and a humidity of an atmosphere within the apparatus or out of the apparatus;

voltage information storing means in which data of transfer voltages corresponding to predetermined discontinuous humidity are stored;

control means for calculating a transfer voltage by interpolating data of the transfer voltage in correspondence to a stored temperature and humidity and measured temperature and humidity in the case that the measured temperature and humidity do not coincide with the discontinuous temperature and humidity stored in said voltage information storing means; and voltage applying means for applying the transfer voltage calculated by said control means to the transfer means, wherein said control means performs a linear interpolation with respect to at least one of the temperature and the humidity.

2. An image forming apparatus, comprising:

a toner image carrier for carrying a toner image formed in correspondence to image data;

transfer means to which a voltage having a polarity different from that of the toner is applied and which transfers the toner image formed on said toner image carrier to a recording medium;

temperature and humidity detecting means for measuring a temperature and a humidity of an atmosphere within the apparatus or out of the apparatus;

voltage information storing means in which data of transfer voltages corresponding to predetermined discontinuous humidity are stored;

control means for calculating a transfer voltage by using data of the transfer voltage in correspondence to a stored temperature and humidity and measured temperature and humidity in the case that the measured temperature and humidity do not coincide with the discontinuous temperature and humidity stored in said voltage information storing means; and voltage applying means for applying the transfer voltage calculated by said control means to the transfer means, wherein the transfer voltage is stored in said voltage information storing means so as to form a matrix having axes of the temperature and the humidity, and the control means calculates the transfer voltage in accordance with at least one of the following formulas (a) to (c) when setting R(t, h) to the value of the transfer voltage at the measured temperature t° C. and the relative humidity h % RH, respectively setting upper and lower temperatures of the temperature t° C. stored in said voltage information storing means to Tn−1° C. and Tn° C. and respectively setting upper and lower humidity of the relative humidity to Hn−1% RH and Hn % RH, (a) in the case that both of the temperature t° C. and the relative humidity h % RH do not coincide with the temperature and the humidity stored in said voltage information storing means, $$\begin{aligned} R(t, h) = \{&R(Tn, Hn) \times (h - Hn - 1) \times (t - Tn - 1) + \\ &R(Tn, Hn - 1) \times (Hn - h) \times (t - Tn - 1) + \\ &R(Tn - 1), Hn) \times (h - Hn - 1) \times (Tn - t) + \\ &R(Tn - 1), Hn - 1) \times (Hn - h) \times (Tn - t) \div \\ &\{(Hn - Hn - 1) \times (Tn - Tn - 1)\} \end{aligned}$$

(b) in the case that only the relative humidity h % RH does not coincide with the humidity stored in said voltage information storing means, $$\begin{aligned} R(t, h) = \{&R(t, Hn) \times (h - Hn - 1) + \\ &R(t, Hn - 1) \times (Hn - h) \div \\ &(Hn - Hn - 1) \end{aligned}$$

(c) in the case that only the temperature t° C. does not coincide with the temperature stored in said voltage information storing means, $$\begin{aligned} R(t, h) = \{&R(Tn, h) \times (t - Tn - 1) + \\ &R(Tn - 1, h) \times (Tn - t) \div \\ &(Tn - Tn - 1). \end{aligned}$$

3. An image forming apparatus, comprising:

a toner image carrier for carrying a toner image formed in correspondence to image data;

transfer means to which a voltage having a polarity different from that of the toner is applied and which transfers the toner image formed on said toner image carrier to a recording medium;

temperature and humidity detecting means for measuring a temperature and a humidity of an atmosphere within the apparatus or out of the apparatus;

voltage information storing means in which data of transfer voltages corresponding to predetermined discontinuous humidity are stored;

control means for calculating a transfer voltage by interpolating data of the transfer voltage in correspondence to a stored temperature and humidity and measured temperature and humidity in the case that the measured temperature and humidity do not coincide with the discontinuous temperature and humidity stored in said voltage information storing means; and voltage applying means for applying the transfer voltage calculated by said control means to the transfer means, wherein the transfer voltage is stored in said voltage information storing means so as to form a matrix having axes of the temperature and the humidity, and the control means calculates the transfer voltage in accordance with at least one of the following formulas (a) to (c) when setting R(t, h) to the value of the transfer voltage at the measured temperature t° C. and the relative humidity h % RH, respectively setting upper and lower temperatures of the temperature t° C. stored in said voltage information storing means to Tn−1° C. and Tn° C. and respectively setting upper and lower humidity of the relative humidity to Hn−1% RH and Hn % RH, (a) in the case that both of the temperature t° C. and the relative humidity h % RH do not coincide with the temperature and the humidity stored in said voltage information storing means, $$R(t, h) = \{R(Tn, Hn) \times (h - Hn - 1) \times (t - Tn - 1) + R(Tn, Hn - 1) \times (Hn - h) \times (t - Tn - 1) + R(Tn - 1, Hn) \times (h - Hn - 1) \times (Tn - t) + R(Tn - 1, Hn - 1) \times (Hn - h) \times (Tn - t)\} \div \{(Hn - Hn - 1) \times (Tn - Tn - 1)\}$$

(b) in the case that only the relative humidity h % RH does not coincide with the humidity stored in said voltage information storing means, $$R(t, h) = \{R(t, Hn) \times (h - Hn - 1) + R(t, Hn - 1) \times (Hn - h) \div (Hn - Hn - 1)$$

(c) in the case that only the temperature t° C. does not coincide with the temperature stored in said voltage information storing means, $$R(t, h) = \{R(Tn, h) \times (t - Tn - 1) + R(Tn - 1, h) \times (Tn - t) \div (Tn - Tn - 1).$$

* * * * *